United States Patent [19]

Guillemet

[11] Patent Number: 4,996,814

[45] Date of Patent: Mar. 5, 1991

[54] INSULATED, WEATHERPROOF WINDOW FRAME OF SYNTHETIC RESIN MATERIAL

[75] Inventor: Guy Guillemet, Terrebonne, Canada

[73] Assignee: Les Produits Duvernay Ltée, St-Leonard, Canada

[21] Appl. No.: 471,793

[22] Filed: Jan. 29, 1990

[51] Int. Cl.[5] ..... E06B 1/26; E06B 1/40; E06B 3/20

[52] U.S. Cl. ..... 52/656; 52/207; 52/208; 52/217; 52/455; 99/DIG. 1; 99/DIG. 2

[58] Field of Search ..... 52/656, 207, 208, 217, 52/455; 49/DIG. 1, DIG. 2

[56] References Cited

U.S. PATENT DOCUMENTS

| | | | |
|---|---|---|---|
| 3,903,669 | 9/1975 | Pease, Jr. et al. | 52/455 |
| 4,387,542 | 6/1983 | Wehr | 52/455 X |
| 4,674,246 | 6/1987 | Giguere | 52/207 |
| 4,831,781 | 5/1989 | Morton | 49/DIG. 2 X |

*Primary Examiner*—David A. Scherbel

*Assistant Examiner*—Deborah McGann Ripley

[57] ABSTRACT

An insulated, weatherproof window frame of synthetic resin material. The frame is comprised of inner and outer one-piece molded peripheral frame members both secured together with fasteners isolated from an outer surface of the outer frame member. The outer frame member also has an upper sash frame molded integral therewith and is formed with a sill provided with a water-evacuation slope and an integrally formed backsplash support wall disposed rearwardly on the sill. A lower moving sash is guidingly retained between the opposed parallel inner side walls rearwardly of the upper sash and sash has a lower sash frame member provided with a horizontal lower seal member for sealing support engagement with the backsplash support wall. The lower sash frame member has a depending protective flange spaced forwardly and overlying the seal member and cooperating with the backsplash support wall to isolate the seal member from water directed at the backsplash.

14 Claims, 3 Drawing Sheets

Fig. 1
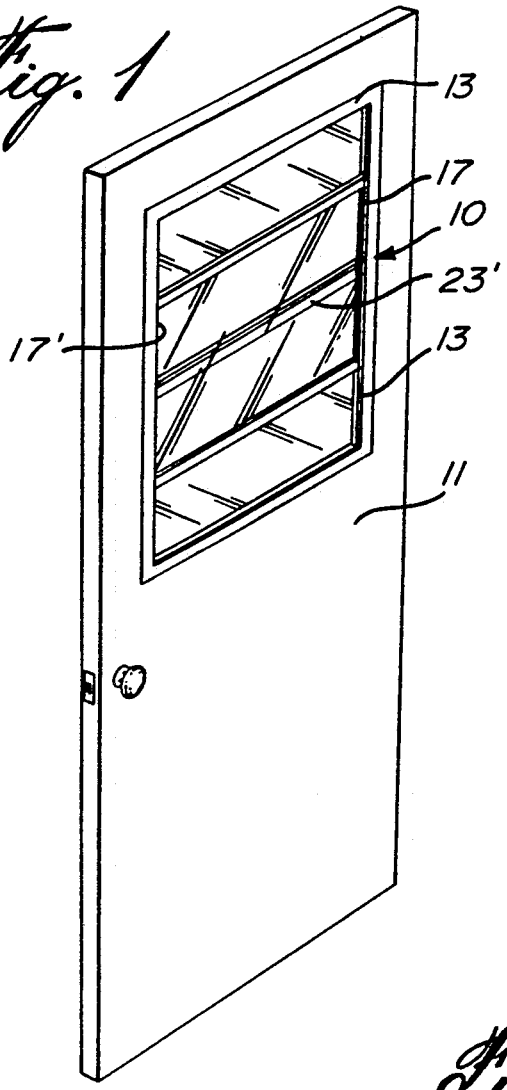
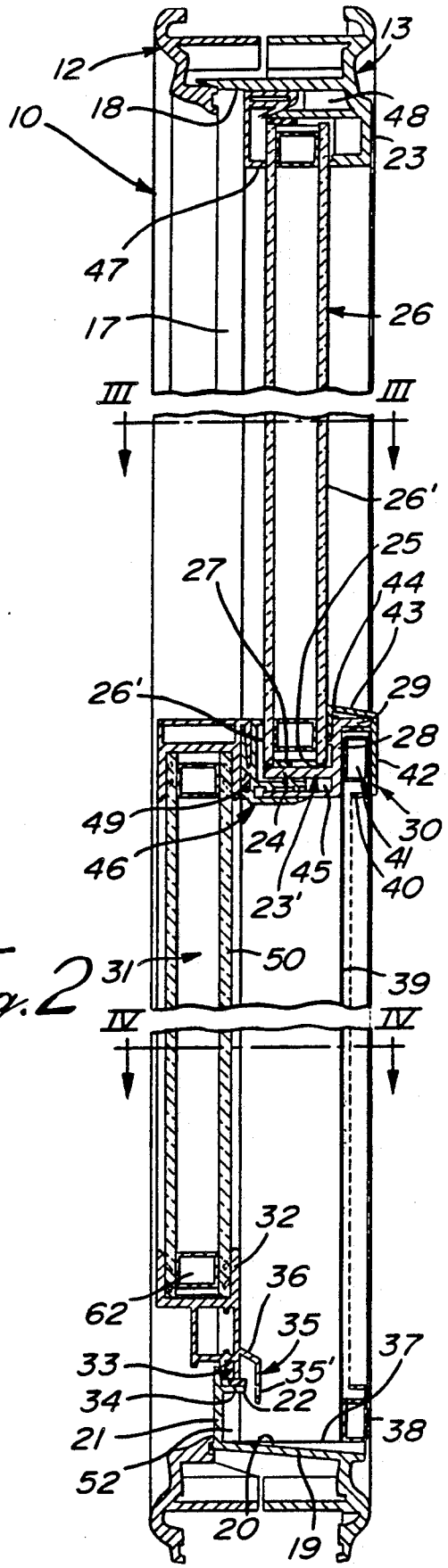
Fig. 2
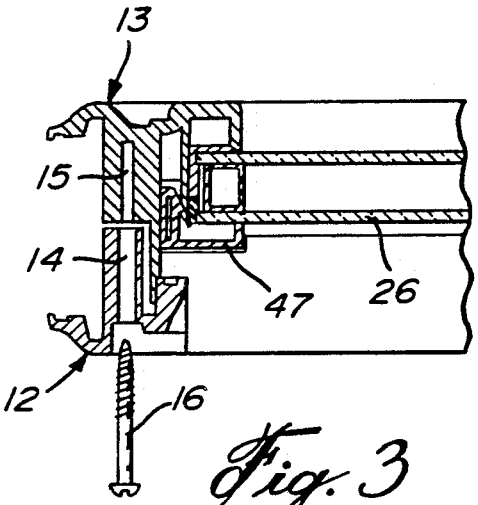
Fig. 3

INSULATED, WEATHERPROOF WINDOW FRAME OF SYNTHETIC RESIN MATERIAL

BACKGROUND OF INVENTION (a) Field of the Invention

The present invention relates to an insulated window frame of synthetic resin material and wherein the outer peripheral frame member is molded in one piece and has a fixed upper sash frame also molded integral therewith. The bottom sill molded with the outer peripheral frame is also provided with an integrally formed backsplash support wall which supports a moving window sash in an insulating manner and wherein all frame members are formed of plastics material for thermal insulation and to make the entire window substantially weatherproof.

(b) Description of Prior Art

Various window frame structures made of synthetic resin material are known. It is also known to construct these windows with snap-in attachment parts. However, in the majority of known window frame structures that are made of synthetic resin material, there are fasteners which extend through the outer frame, therefore exposing the fasteners to outside ambient temperatures, causing these fasteners to act as thermal conductors. Also, the majority of window frame structures constructed of synthetic resin material also utilize various other products such as metal or wood in combination with the resin material. In other words, the core of some of the elements may be wood or metal and these are covered with plastic strips. These are therefore costly to fabricate and often require fasteners in order to secure the core material to the outside covering. The metal cores also act as thermal conductors within the window frame and sashes.

SUMMARY OF INVENTION

It is a feature of the present invention to provide an improved insulated, weatherproof window frame of synthetic resin material which substantially overcomes all of the above-mentioned disadvantages of the prior art.

Another feature of the present invention is to provide an insulated, weatherproof window frame of synthetic resin material, and wherein the outer peripheral frame member is a one-piece molded member free of any fasteners.

Another feature of the present invention is to provide an insulated, weatherproof window frame of synthetic resin material and wherein an upper sash frame is molded integral with an outer one-piece molded peripheral frame member and wherein a fixed outer sash pane is secured within the integrally molded frame in an insulating non-thermally conductive manner. The lower moving sash is displaced against seals located about the area below the upper fixed sash frame with the seals protected from capillary attraction.

Another feature of the present invention is to provide an insulated, weatherproof window frame of synthetic resin material and wherein the outer one-piece molded peripheral frame member is provided with a sash which has a water-evacuation slope and an integral backsplash support wall which insulatingly supports a lower moving sash in a weatherproof manner without the use of fasteners.

Another feature of the present invention is to provide an insulated, weatherproof window frame of synthetic resin material having a fixed and a moving sash and wherein the sashes are retained within the frame member by snap-fit synthetic resin members without the use of any fasteners and wherein no fasteners or metal parts are provided at least on the outer exposed surfaces of the outer frame member as well as the fixed and moving sash frame members.

According to the above features, from a broad aspect, the present invention provides an insulated, weatherproof window frame of synthetic resin material and which comprises an inner and an outer one-piece molded peripheral frame member. The inner one-piece frame member has fastener locating means to receive fasteners to secure both frame members together with the fasteners being isolated from an outer surface of the outer frame member. The frame members have opposed parallel inner side walls. The outer frame has an upper sash frame molded integral therewith. The outer frame member is also formed with a sill provided with water-evacuation means and an integrally formed backsplash support wall. A lower moving sash is guidingly retained between the opposed parallel inner side walls rearwardly of the upper sash. The moving sash has a lower sash frame member provided with a horizontal lower seal member for sealing support engagement with the backsplash support wall. The lower sash frame member has a depending protective flange spaced forwardly and overlying the seal member and cooperating with the backsplash support wall to isolate the seal member from water directed at the backsplash.

BRIEF DESCRIPTION OF DRAWINGS

A preferred embodiment of the present invention will now be described with reference to the accompanying drawings in which:

FIG. 1 is a perspective view of the insulated, weatherproof synthetic resin window frame of the present invention as secured to a metal door;

FIG. 2 is a vertical section view of the window frame of the present invention;

FIG. 3 is a cross-section view through section lines III—III of FIG. 2;

DESCRIPTION OF PREFERRED EMBODIMENTS

Figure 4:
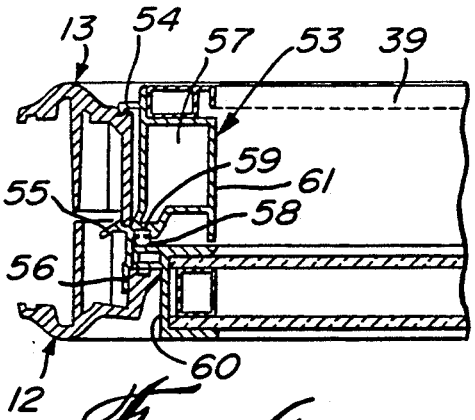
FIG. 4 is a cross-section view through section lines IV—IV of FIG. 2.

Referring now to the drawings, and more particularly to FIG. 1, there is shown generally at 10, the insulated, weatherproof window frame of the present invention as constructed entirely of synthetic resin primaterial and secured in a metal door 11.

Referring now additionally to FIGS. 2 to 6, it can be seen that the window frame 10 is comprised of inner and outer one-piece molded peripheral frame members 12 and 13 respectively. The inner frame member 12 has fastener locating means in the form of holes 14 provided at spaced-apart strategic locations therealong and in registry with a bore 15 provided in the outer peripheral frame member 13. Fasteners in the form of screws 16 extend through the bore 14 and screws into the bore 15 without penetrating the outer frame 13. Therefore, there is no metal exposed on the outer surface of the frame and, therefore, no thermal conductive element is exposed to the outdoors.

The inner and outer frame members 12 and 13 are rectangular frames defining opposed parallel inner side walls 17, an upper wall 18 and a lower sill 19. The lower sill 19 has a downwardly and outwardly sloping surface 20 to evacuate water projected thereon. A backsplash vertical support wall 21 is also formed integral with the sill member. The support wall 21 is also provided with a horizontal support ledge 22 extending forwardly and transverse thereto. The outer peripheral frame member 13 is still further provided with an upper sash frame 23 molded integral therewith. The lower sash frame member 23' of the upper sash frame constitutes a meetrail section which extends across the opposed parallel inner side walls 17 and 17'. The meetrail 23' has a horizontal support wall 24 on which a lower edge 25 of a fixed sash 26 can rest. A sealing compound or strip 27 is disposed intermediate the lower edge 25 and the support wall 24 for sealing engagement. The meetrail 23' is also provided with a vertical front wall 28 which has a forwardly extending top attachment flange 29 to which a screen panel holding member 30 is snap-fitted thereon.

A lower moving sash 31 is guidingly retained between the opposed parallel inner side walls 17 and 17' of the peripheral frame members 12 and 13 and is slidable in a plane space rearwardly of the upper fixed sash 26. The moving sash 31 is provided with a lower sash frame member 32 having a thermal seal member 34 removably secured in a lower channel 33. When the lower sash is in its lowered position, the seal member 34 sits on the horizontal support ledge 22 of the backsplash 21 to provide a thermal seal.

The lower sash frame member 32 is also provided with a depending protective flange 35 which is spaced forwardly and has a downwardly depending vertical wall 35' which overlies the seal member 34 whereby to isolate the seal member from water directed at the backsplash 21. The protective flange 35 also has a sloped top wall portion 36 so that water projected against the outer glass pane 50 or the frame member 32 will be directed outwardly of the backsplash 21. This creates a protective area behind the protective flange 35 which eliminates wetting of the horizontal support ledge 22 and also eliminates capillary attraction of water. Any water projected against the backsplash vertical wall 21 will fall by gravity onto the sill 19 which is sloped downwardly so that the water will seep out. As can be seen, the sill 19 is also provided with a plurality of ribs 37 to support the lower edge member 38 of the screen panel 39 thereon. The upper edge member 40 of the screen panel 39 is in friction fit in a rectangular slot 41 formed between the depending screen panel retention flange 42 of the screen panel holding member 30 and the front wall 28 of the meetrail 23'. The screen panel holding member is also provided with an outwardly sloped top wall 43 to direct water downwardly from the upper pane. The sloped top wall 43 has a glass pane contact sealing ledge portion 44 which is press-fitted between the top attachment flange 29 and the outer glass pane 26' of the fixed sash 26. The manner in which the screen panel 39 is secured within the frame will be described with reference to FIGS. 7A-7C.

As can be seen, the meetrail 23' is further provided with an elongated retention slot 45 under the horizontal support wall 24. An intermediate spacer member 46 is sealingly secured into the retention slot to overlie a bottom inner edge portion of the fixed sash 26. The spacer member 46 extends outwardly of the fixed pane in planar alignment with a sash spacer member 47 secured to the opposed parallel side walls 17 and the transverse top section of the rectangular frames immediately adjacent the upper sash. These sash spacer members 47 are press-fitted in sealing engagement with side and upper cavities 48 formed in the outer peripheral frame member 13. Accordingly, the upper fixed sash is secured to the outer frame without the use of any metal fasteners which are thermal conductors. Also, the spacer member 47 maintains the lower moving sash 31 in fixed spaced relationship with the upper sash when displaced thereagainst. The lower horizontal intermediate spacer member 46 is also provided with a removable seal member 49 in an outer wall thereof for frictional engagement with the outer glass pane 50 of the moving sash 31.

Figure 5:
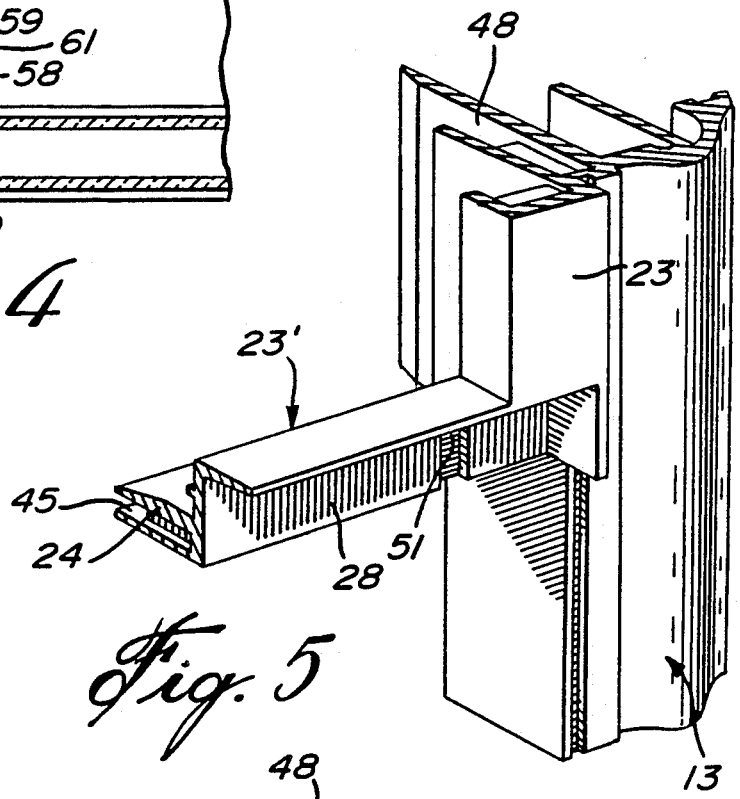
FIG. 5 is a fragmented perspective view of the outer peripheral frame member illustrating the construction of the meetrail of the upper sash frame.

As can be seen in FIG. 5, the meetrail 23' is also provided with weep holes 51 therein in the lower portion of the front wall 28 and above the top surface of the support wall 24 so that any water that may infiltrate between the upper sash and the screen panel holding member will seep out through these weep holes and fall onto the lower sill by gravity.

Figure 6:
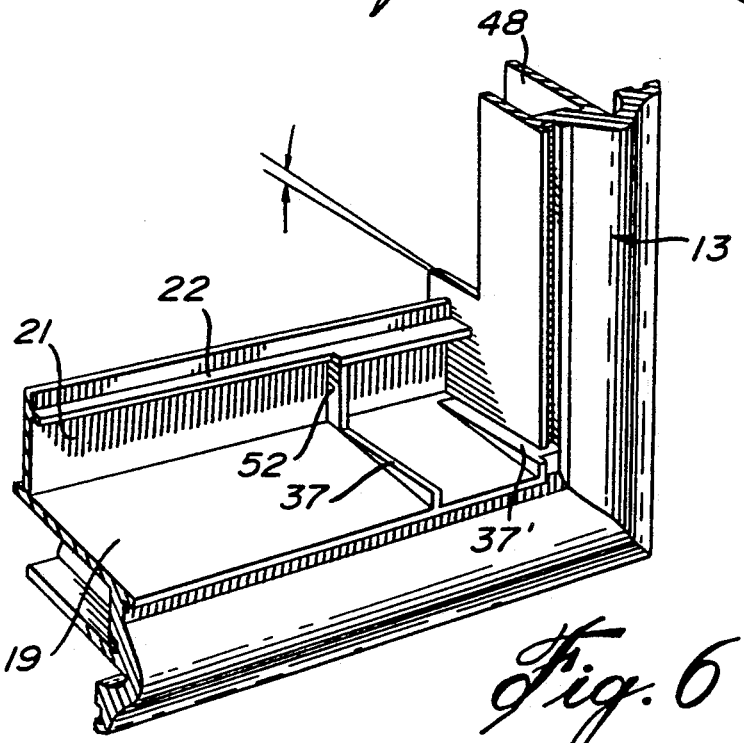
FIG. 6 is a fragmented perspective view of the outer peripheral frame member showing the construction of the sill and backsplash formed integral therewith.

Referring now to FIG. 6, it can seen that the horizontal support ledge 22 of the backsplash vertical support wall 21 is reinforced by spaced-apart reinforcing ribs 52. The end portions of the lower sill 19 have a screen frame support ledge 37' lying in the same plane as the ribs 37 whereby to support thereon a thermal insulating frame member 53, as better illustrated in FIG. 4. This frame member 53 is secured to the opposed side walls 17 and 17' of the inner and outer peripheral frame members 12 and 13 and disposed beneath the upper sash meetrail 23' and snap-fitted to the side frames by the integrally molded prong members 54 and 55. A further prong member 56 guide the inner frame member 12, when installing to the door.

Figure 7A:
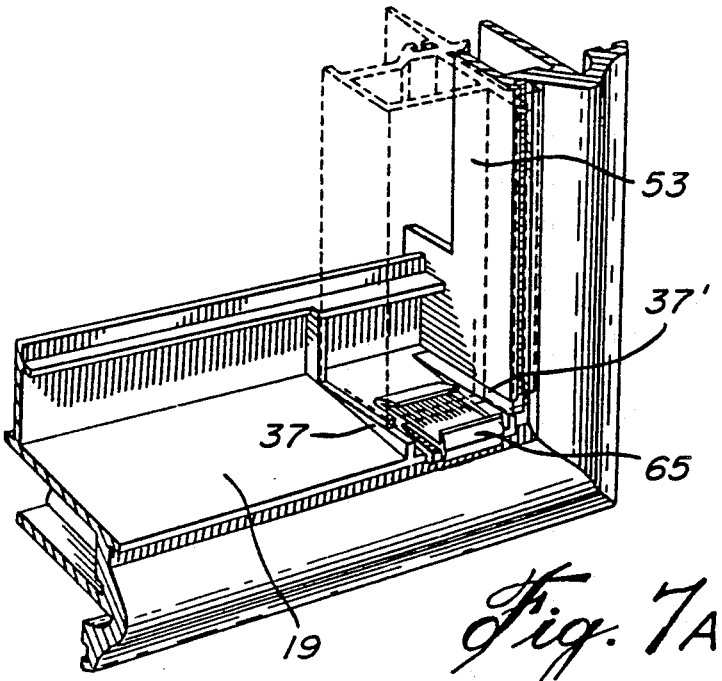
FIG. 7A is a perspective view illustrating the use of a screen panel retention bracket.
Figure 7B:
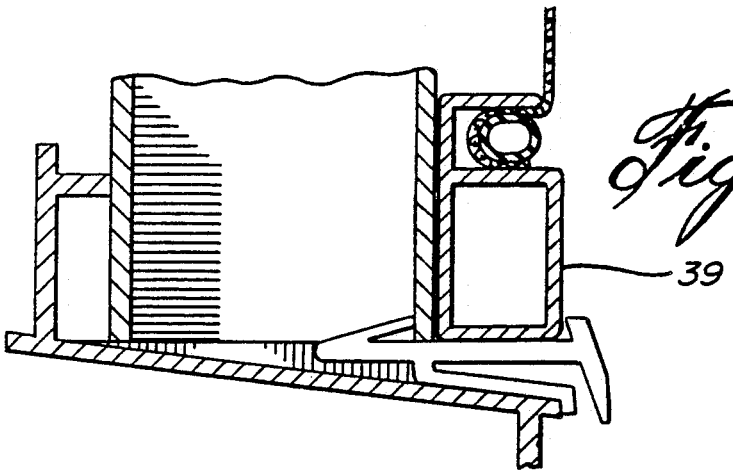
FIG. 7B is a section view illustrating the position of the bracket of FIG. 7A when in use.
Figure 7C:
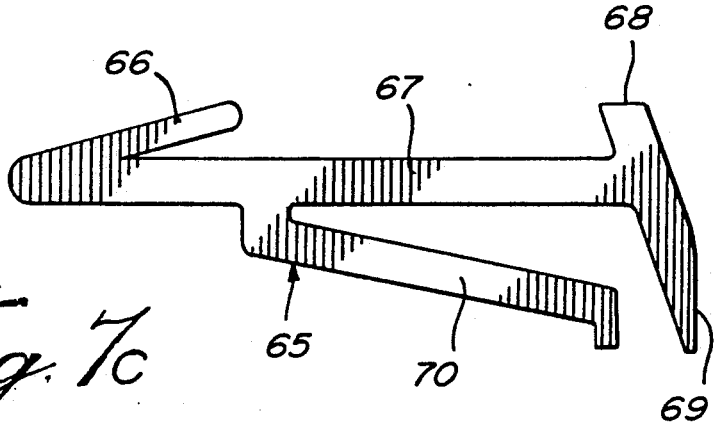
FIG. 7C is a cross-section view of the screen panel retention bracket.

Referring now to FIGS. 7A, 7B, and 7C there will be described the construction and use of a screen frame retention bracket 65. As herein shown, the screen frame retention bracket is positionable at each corner of the lower sill 19 between the frame support ledge 37' and the rib 37 on which sits the thermal insulating frame 53. As is also shown in FIG. 7A, this thermal insulating frame is hollow and could contain therein insulating foam material or the like but has at least in the lower portion thereof a hollow portion whereby to receive the retention prong 66 of the screen frame retention bracket 65 to secure the bracket to the lower edge of the thermal insulating frame 63 as is better seen in FIG. 7B.

As shown in FIG. 7C, the screen frame retention bracket 65 comprises a screen frame support wall 67 having a retention ridge 68 elevated from the support wall in the front end thereof. A depending flange 69 is formed integral with the ridge 68 and is utilized to apply downward pressure to bend the support 67 in the direction of the bottom sill engaging wall 70, when in use, in order to position and secure the screen panel into the lower pane area of the outer peripheral frame member 13. Accordingly, the screen panel 39 is positively retained within the lower pane opening and easily removable therefrom by applying downward pressure on the depending flange 69.

As can also be seen in FIG. 4, this thermal insulating frame member 53 has a rectangular hollow frame section 57 and a lower sash seal 58 is disposed in a slotted cavity 59 which is located in an inside vertical edge portion of the frame member 53. This seal 58 is in frictional contact with a side frame member 60 of the moving sash 31. A forwardly extending protective wall 61 is also formed integral with the frame members 53 and terminates closely spaced to the moving sash side frame member 60 to protect the seal 58. Accordingly, all of the seals which are in contact with the moving sash are protected from water and capillary attraction as is the case with the protective flange 35 in the lower sash frame member 32. The lower sash frame member 32 is also provided with a hollow frame section 62 to provide an air trap for thermal insulation.

The window frame of the present invention was developed to be constructed entirely from thermal insulating plastics and intended to be assembled without the use of any metal fasteners other than the screws 16 exposed to the inside peripheral frame only but isolated from the outside frame. Accordingly, there is provided a substantially sealed assembly comprised of a fixed and moving sash within a rectangular window frame to prevent the conductivity of cold temperature and water from the outside. The specific design of the molded upper sash frame and the sill with the integrally formed backsplash cooperating with the lower sash frame member provides excellent thermal insulation, seal protection and water evacuation. Although the present window frame has been described as being adapted to a metal door, it is within the scope of the present invention to adapt this window frame to other non-metallic structures. Also, the upper part of the frame can be modified to have a decorative window panel and not necessarily of rectangular cross-section, but could be semi-circular or have another shape with its outer and inner frame members being molded together with the rectangular frames and assembled in a similar fashion.

It can also be seen that with the present invention, the window is very easily assembled on site with the upper sash and its constituent parts assembled onto the outer frame member 13. The thermal insulating frame member 53 and the moving lower sash 31 are then assembled with the inner rectangular frame 12 and everything is secured together by the screw fasteners 16. It can also be seen that with this type of assembly, any defective parts can be replaced by simply dismantling the frame or simply loosening the screws extending through the inner rectangular frame member 12.

It is within the scope of the present invention to cover any obvious modifications of the preferred embodiment described herein provided such modifications fall within the scope of the appended claims.

I claim:

1. An insulated, weatherproof window frame of synthetic resin material comprising an inner one-piece molded peripheral frame member and outer one-piece molded peripheral frame member; said inner one-piece frame member having fastener locating means to receive fasteners to secure both said frame members together with said fasteners being isolated from an outer surface of said outer frame member; said frame members having opposed parallel inner side walls; said outer frame having an upper sash frame molded integral therewith; said outer frame member having a molded lower sill provided with water-evacuation means and an integrally formed backsplash support wall, and a lower moving sash guidingly retained between said opposed parallel inner side walls rearwardly of said upper sash; said moving sash having a lower sash frame member provided with a horizontal lower seal member for sealing support engagement with said backsplash support wall; and said lower sash frame member having a depending protective flange spaced forwardly and overlying said seal member and cooperating with said backsplash support wall to isolate said seal member from water directed at said backsplash.

2. A window frame as claimed in claim 1 wherein said inner and outer frame members are rectangular frame members for securement in a rectangular opening, said backsplash support wall having a horizontal support ledge in a top portion for receiving said seal member thereon.

3. A window frame as claimed in claim 2 wherein said water evacuation means is constituted by a downwardly outward sloping top surface of said sill, and a plurality of spaced-apart support ribs on said sill having a top surface terminated in a horizontal plane to support a screen pane thereacross.

4. A window frame as claimed in claim 2 wherein said fixed upper sash frame has a lower transverse meetrail section extending from across said opposed parallel inner side walls, and said meetrail having a horizontal support wall on which a lower edge of said fixed sash is disposed and a vertical front wall having a forwardly extending top attachment flange.

5. A window frame as claimed in claim 4 wherein a screen panel holding member is clampingly secured to said forwardly extending top attachment flange, said screen panel holding member having an outwardly sloped top wall extending from a glass pane contact sealing ledge portion thereof and a depending screen panel retention flange spaced forwardly of and substantially parallel to said vertical front wall to receive an upper edge member of a screen panel in close friction fit therebetween.

6. A window frame as claimed in claim 4 wherein said lower transverse meetrail section is further provided with an elongated retention slot under said horizontal support wall, and an intermediate spacer member sealingly secured to said retention slot to overlie a bottom horizontal inner edge portion of said fixed sash, said spacer member extending outwardly in planar alignment with a sash spacer member secured to said opposed parallel side walls adjacent said fixed upper sash and a transverse top section of said outer peripheral frame member and overlying the side and top edge portions of said fixed upper sash to maintain said lower sash spaced from said fixed upper sash when displaced thereagainst.

7. A window frame as claimed in claim 6 wherein said intermediate spacer member is provided with a seal extending therealong and in contact with an outside surface of said lower sash.

8. A window frame as claimed in claim 4 wherein said meetrail is further provided with two or more weep holes in a lower edge of said top attachment flange adjacent said horizontal support wall.

9. A window frame as claimed in claim 2 wherein said backsplash support wall is a vertical wall, said support ledge being a reinforced ledge extending horizontally forward across said vertical wall and spaced from a free top edge of said vertical wall.

10. A window frame as claimed in claim 9 wherein said depending protective flange is molded integrally with said lower sash frame member and has a forwardly downward sloping top wall and a downardly depending vertical end wall which overlies said seal member, said seal member being isolated from any capillary effect.

11. A window frame as claimed in claim 4 wherein a thermal insulating frame member is secured to said opposed side walls of said inner and outer peripheral frame members beneath said upper sash frame and has a rectangular hollow frame section disposed below said fixed upper sash, a lower sash seal retained in an inner vertical edge portion of said hollow frame section and in frictional contact with a side frame member of said moving sash, and a forwardly extending protective wall closely spaced to said side frame member to protect said lower sash seal.

12. A window frame as claimed in claim 1 wherein said top and bottom sashes are retained in said peripheral frame members by insulated extruded moldings which are snap-fit to said peripheral frame members free of any metal fasteners.

13. A window frame as claimed in claim 11 wherein said inner and outer frame members, said upper sash frame and lower sash frame members, said screen panel holding member, said thermal insulating frame members and said screen panel holding member are all molded of thermoplastic material.

14. A window frame as claimed in claim 1 wherein said window frame is a rectangular window frame secured to a door having at least an outer metal door panel surface.

* * * * *